United States Patent [19]

Park

[11] Patent Number: 4,958,627

[45] Date of Patent: Sep. 25, 1990

[54] THERAPEUTIC BED

[76] Inventor: Ki D. Park, 920 H Street NE., Washington, D.C. 20002

[21] Appl. No.: 213,890

[22] Filed: Jun. 30, 1988

[51] Int. Cl.[5] ..... A61H 1/00

[52] U.S. Cl. ..... 128/33; 128/35

[58] Field of Search ..... 5/190, 200 R, 131, 132, 5/186 R, 189, 194, 207, 212, 227, 457; 128/33-36

[56] References Cited

U.S. PATENT DOCUMENTS

| | | | |
|---|---|---|---|
| 1,813,019 | 7/1931 | Brown | 4/194 |
| 2,156,664 | 5/1939 | Litle | 5/190 |
| 2,433,548 | 12/1947 | Ecks | 128/33 |
| 2,924,216 | 2/1960 | Stewart | 128/33 |
| 3,019,785 | 2/1962 | Eiden | 128/33 |
| 3,027,892 | 4/1962 | Searl | 128/33 |
| 3,064,642 | 11/1962 | Stewart | 128/33 |
| 3,129,441 | 4/1964 | Zastera et al. | 5/190 |
| 3,311,935 | 4/1967 | Petty | 128/33 |
| 3,405,709 | 10/1968 | Mathers | 128/33 |
| 3,455,296 | 7/1969 | McCaleb | 128/33 |
| 3,529,311 | 9/1970 | Crawford | 128/33 |
| 3,732,860 | 5/1973 | Thurmer | 128/33 |
| 3,914,811 | 10/1975 | Francis | 5/457 |
| 4,061,137 | 12/1977 | Sandt | 128/33 |
| 4,141,096 | 2/1979 | Hale et al. | 128/33 |
| 4,230,098 | 10/1980 | Uematsu | 128/33 |
| 4,360,736 | 11/1982 | Weissenfluh | 5/457 |
| 4,435,864 | 3/1984 | Callaway | 5/457 |
| 4,551,874 | 11/1985 | Matsumura | 5/457 |
| 4,559,929 | 12/1985 | Hseu | 128/33 |
| 4,769,864 | 9/1988 | Park | 5/190 |

FOREIGN PATENT DOCUMENTS

| | | | |
|---|---|---|---|
| 1229152 | 9/1960 | France | 5/190 |
| 7708597 | 2/1979 | Netherlands | 5/190 |
| 21821 | of 1904 | United Kingdom | 5/194 |
| 444455 | 3/1936 | United Kingdom | 5/190 |

*Primary Examiner*—Edgar S. Burr
*Assistant Examiner*—Huong Q. Pham
*Attorney, Agent, or Firm*—Birch, Stewart, Kolasch & Birch

[57] ABSTRACT

An improved therapeutic bed comprising a plurality of substantially parallel rubber wires placed on a bed frame and a vibrating motor and an intermittent hitting plate operatively associated with the rubber wires for massaging and treating various portions of the human body.

4 Claims, 3 Drawing Sheets

THERAPEUTIC BED

BACKGROUND OF THE INVENTION

1. Field of the Invention

The present invention relates to a therapeutic bed and more particularly, to a rubber wire bed which is associated with a vibration motor and intermittent hitting plate for a plurality of tensible tubular wires for manipulating the tissues of the human body reclining thereon. The therapeutic bed is utilized by the human being particularly, the pneumatic or lumbago patient, for massaging any desired regions of the human body lying prone thereon.

2. Description of the Prior Art

Many types of therapeutic beds are well known in the art which use air bags or water containers. However, since these air bags or water containers bulge at their central portion, a body lying thereon becomes unstable. Furthermore, because air and/or water is displaced when pressure is applied thereto, the pressure force from these bags or containers is not concentrated at the desired regions of the body such as joints, bones, or muscles of human body which require therapeutic assistance.

U.S. Pat. No. 4,769,864 issued to the present inventor discloses a therapeutic bed including a plurality of parallel wires for defining a bed floor. However, this therapeutic bed cannot desirably achieve the efficiency of the massaging effect of the present invention.

SUMMARY OF THE INVENTION

Accordingly, it is an object of the present invention to provide an improved therapeutic bed for massaging regions of the human body.

Another object of the present invention is to provide an improved therapeutic bed which is structured with a plurality of individual elongated wires which are arranged parallel to each other and disposed within bed frames for directly contacting various portions of the human body reclining thereon.

A further object of the present invention is to provide an improved therapeutic bed which includes a bed floor defined by the plurality of wires, a vibrating motor and an intermittent hitting plate operative associated with the bed floor, a height-adjusting member connected to the hitting plate can be adjusted thereby controlling a space between the bed floor and the human body Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

Briefly, the present invention relates to an improved therapeutic bed comprising a plurality of substantially parallel rubber wires placed on a bed frame and a vibrating motor and an intermittent hitting plate operatively associated with the rubber wires for massaging and treating various portions of the human body.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
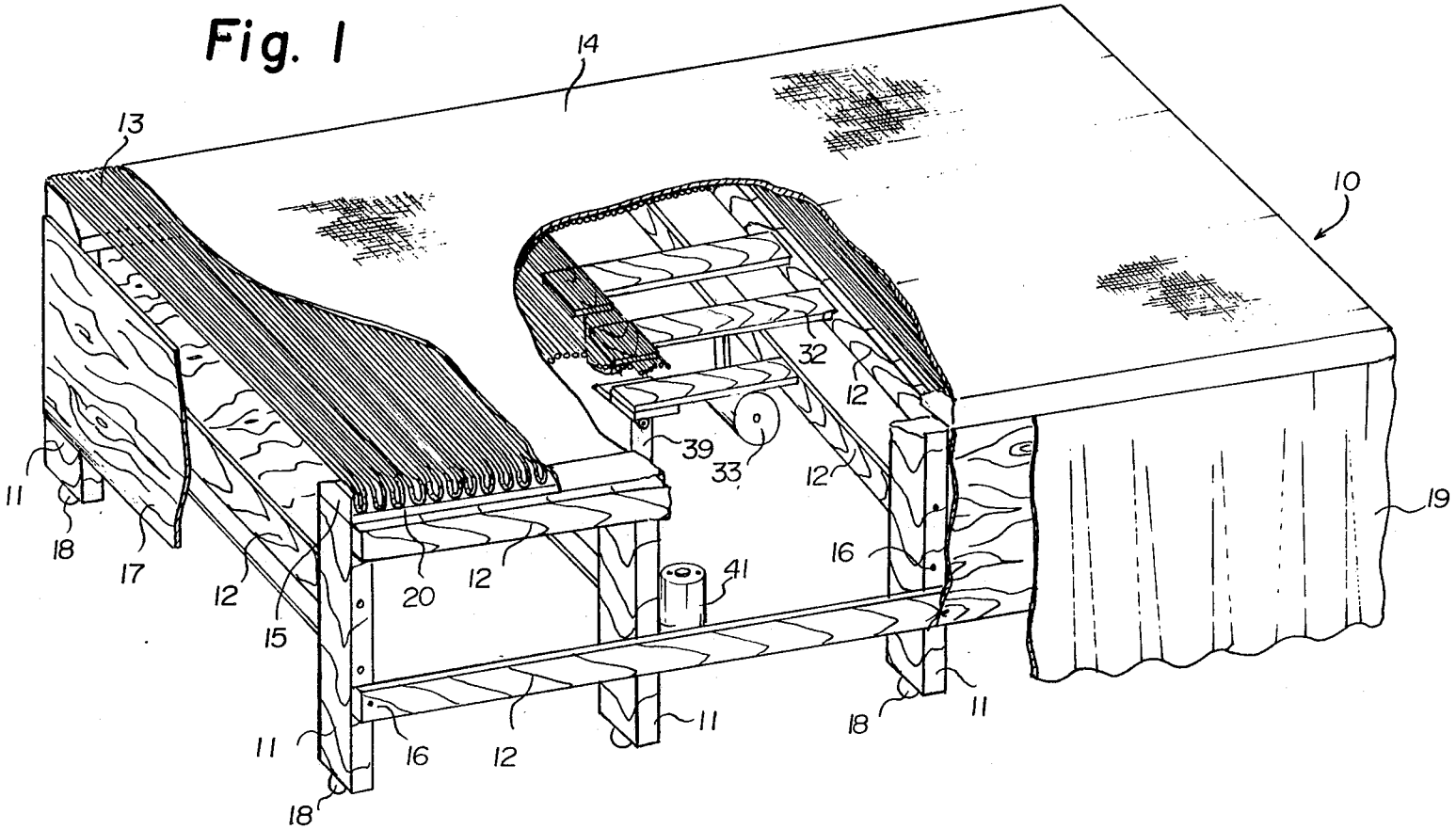
FIG. 1 is a perspective view of the therapeutic bed of the present invention showing in cut away portions thereof the main components of the therapeutic bed.
Figure 2:
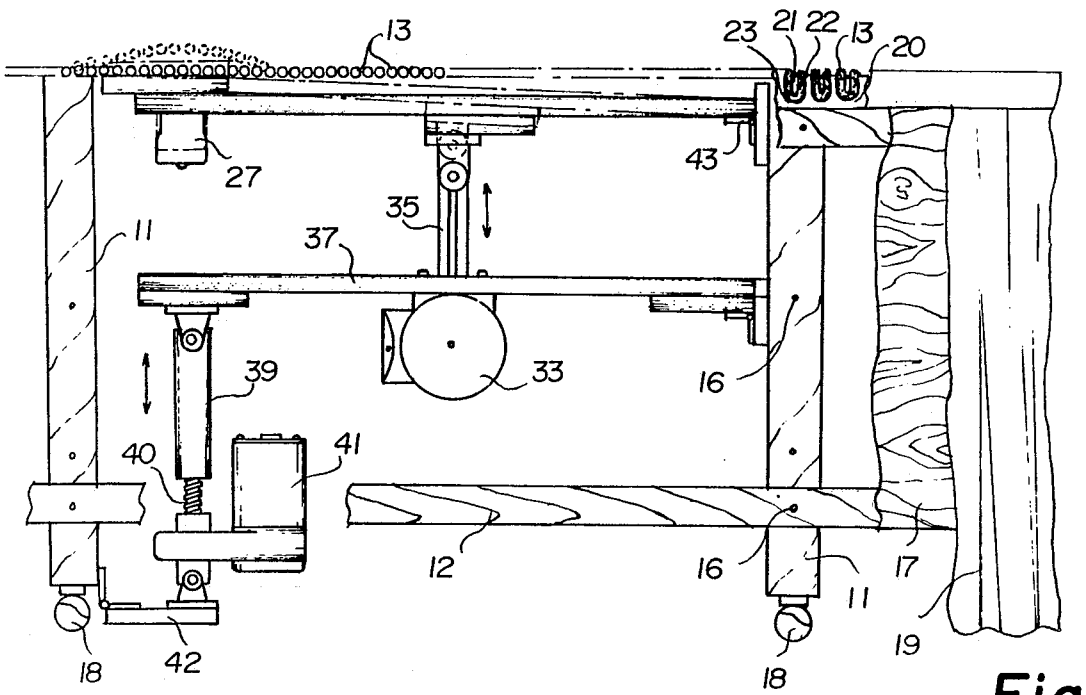
FIG. 2 is a front view of the main components of the therapeutic bed of the present invention.
Figure 3:
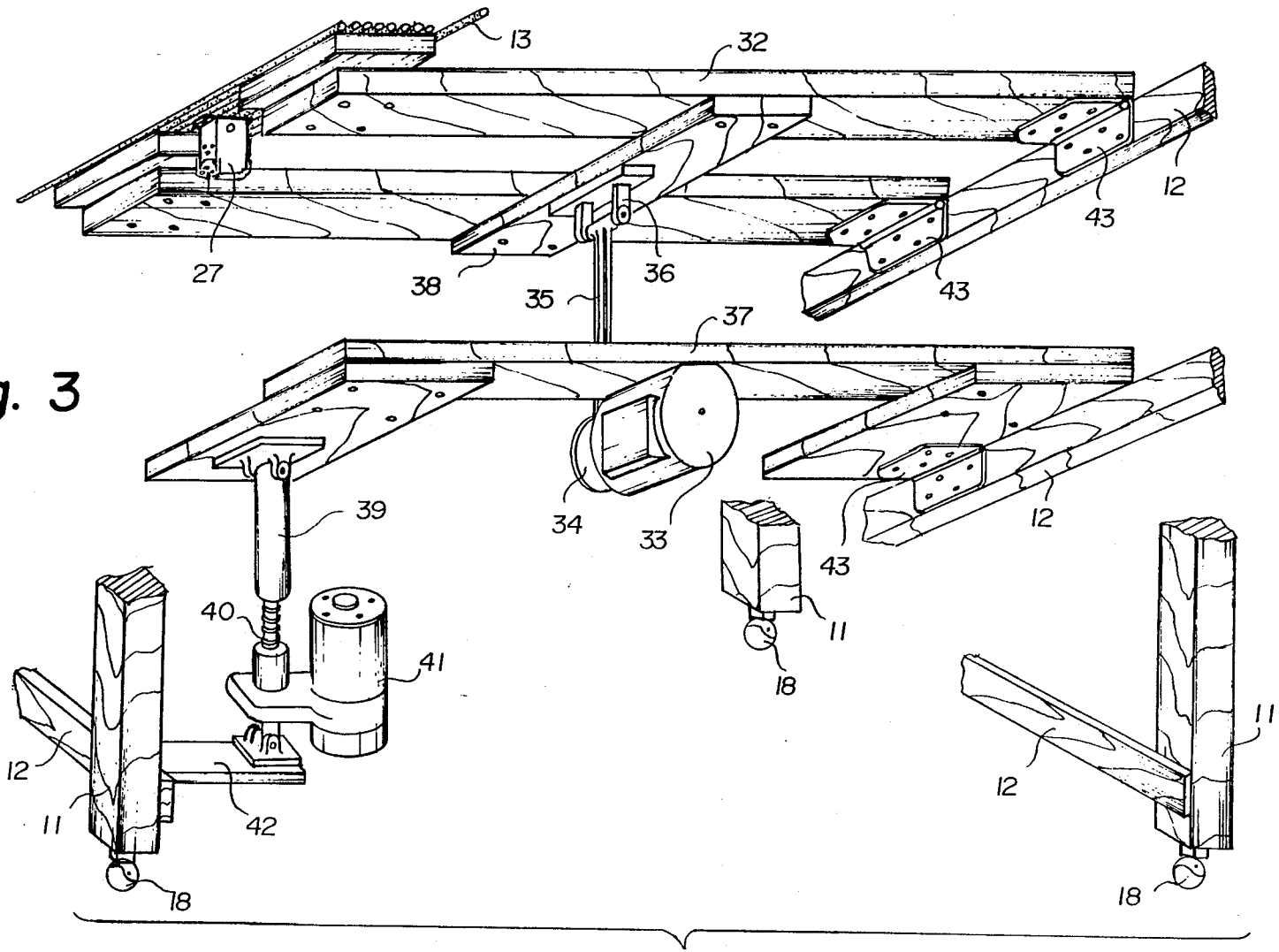
FIG. 3 is a perspective view of main components of the therapeutic bed of the present invention.

Referring now in detail to the drawings for the purpose of illustrating the present invention, the therapeutic bed 10 as shown in FIGS. 1, 2, and 3 includes bad frames defining base members 11 and longitudinal and transverse frames 12 connected to the base members 11, a plurality of tensible tubular wires 13 provided with a thin bed pad 14, a pair of tapered connecting members 15 attached to the top of the base members at the four corners for connecting the tensible tubular wires 13 thereto, and a vibration assembly disposed under a bed floor and in the center portion of the therapeutic bed 10.

The longitudinal and transverse frames 12 are attached to and supported with the base members 11 through nails 16. A plurality of side panels 17 connect with the longitudinal and transverse frames 12. Each base member 11 has a roller 18 disposed on the bottom thereof for readily moving the bed 10. The therapeutic bed 10 includes a bedding 19 along the side walls thereof.

The pair of connecting members 15 having a right angle portion are attached to the base members 11. A pair of L-shaped brackets 20 are tightly attached to the right angle portion of the pair of connecting members 15, respectively, and are further provided with a plurality of separating partitions 21 and 22, which alternately extend around the edge of the brackets 20 and a plurality of slots 23, disposed at the ends of the alternate partitions 19 for holding the tensible wires 13 in the slots 23 and spaces disposed between partitions 21 and 22. Thus, the parallel wires 13 connected between the side slots 23 on opposite sides of the longitudinal frames 12 form a tensible bed floor for directly contacting various regions of the human body. At this time, since the tensible wires 13 extend across the bed, the wires 13 can readily massage joint portions, muscles, and bones of the human body. Furthermore, since the tensible wires 13 can be extended, the pressure power can be varied according to need by tightening the wires in order to concentrate the desired pressure to the joint portions of human body for treating lumbago or pneumatic disease or the like. The tensible wires 13 are made of a flexible, stretchable material such as a natural or synthetic rubber, a plastic material, a thermoplastic material, or the like. The wire 13 should have the property of stretchability in order to vary the resistance to the weight of the human body. Although the wires 13 are typically of solid construction they can also include cord or metal wires coated with a rubber or plastic material.

Figure 4:
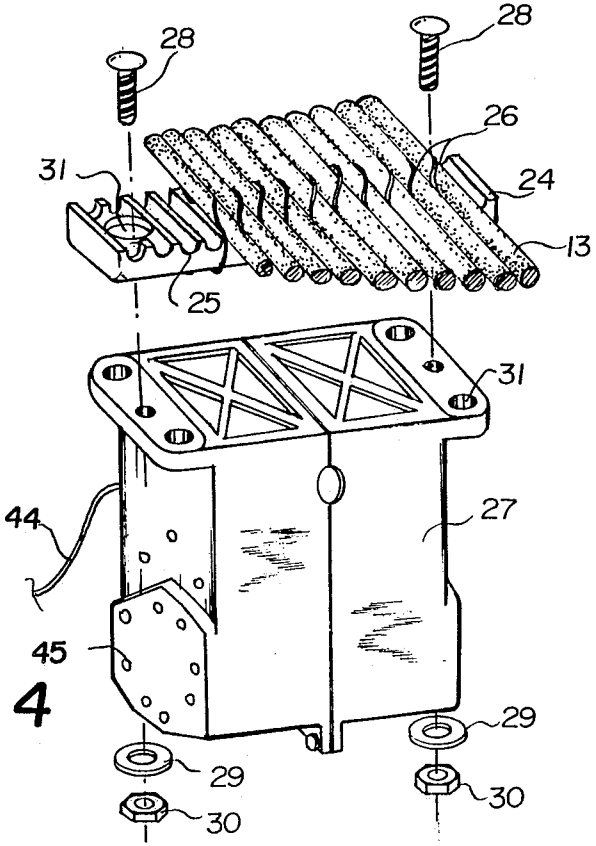
FIG. 4 is an exploded perspective view showing a vibrating motor of the bed according to the present invention.

As shown in the FIG. 4, a motor holding member 24 includes a plurality of elongated slots 25 for receiving the plurality of wires 13 by a steel wire or a loop 26. The motor holding member 24 holds a vibrating motor 27 by bolts 28, washers 29 and nuts 30 through apertures 31. The vibrating motor 27 is provided with an electric wire 44 and air holes 45. When the vibrating motor 27 is activated, the plurality of tensible wires 13 which is secured to the motor holding member 24 by the loop 26, are simultaneously vibrated for accelerating the massage of any desired region of the human body.

As shown in FIG. 2 and FIG. 3, the bed floor formed with the plurality of tensible tubular wires 13 is provided with a intermittent hitting plate 32 disposed under thereof for intermittently hitting the bottom of the bed floor so that the wires go up an down. The hitting plate 32 is attached to a connecting plate 38 which is attached to a motor support 36. The support 36 is moveably connected to a cam arm 35 which connects to a cam 34 of a motor 33. When the motor mounted to a motor support 37, the cam 34 rotates and the cam arm 35 goes up an down, thereby the hitting plate 32 hits the bottom of the bed floor intermittently. A two-way motor 41 rotates an adjusting screw stand 40 in both clockwise and counterclockwise directions by operating a switch (not shown). Therefore the adjusting screw stand 40 goes up and down along a tubular motor support adjusting member 39 connected to the motor support 37 for adjusting the height of the motor support 37 positioned by the motor 33. For example, if the back of the human body is to be close to the bed floor, the motor support makes it go up by operation of the two-way motor.

The therapeutic bed can achieve the function of a conventional mattress. Furthermore, the air can easily communicate through the spaces disposed between the wires-bed floor so that it can help to give the fresh air to supply the human body. Also, since the therapeutic bed can be vibrated and adjusted to a close degree to the human body by operating the vibrating motor 27 and two-way motor, the therapeutic effect can be achieved when compared with conventional bed.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. A therapeutic bed for the human body comprising:

bed frames, connecting members attached to the top of said bed frames, a pair of brackets attached to said connecting members, said brackets comprising a plurality of separate partitions which alternatively extend from an edge of said brackets for defining spaces therebetween and a plurality of slots which are disposed at ends of said alternate separate partitions, a flexible wire passing through said spaces and said slots of said brackets on alternate opposite sides of the bed frames of the therapeutic bed in a serpentine configuration, a vibrating motor attached to said flexible wires for vibrating, and a motor having a cam and mounted to a longitudinal motor support which includes hinges at one end and a motor support adjusting member at the other end thereof, said cam being provided with a cam arm connected to said cam and an intermittent hitting plate for hitting a bed floor formed by said flexible wires, whereby the flexible wires of the therapeutic bed treat and massage desired regions of the human body disposed thereon, said motor support adjusting member including a two-way motor, an adjusting screw stand connected to said two-way motor, and a tubular support for receiving said adjusting screw stand.

2. The therapeutic bed of claim 1, wherein the flexible wire is made of flexible tubular material.

3. The therapeutic bed of claim 1, wherein the vibrating motor is mounted to a motor holding member, said motor holding member including a plurality of slots for engaging the flexible wires by fixing with a wire.

4. The therapeutic bed of claim 1, wherein the flexible wire is a loop.

* * * * *